US008350776B1

(12) United States Patent
Bauman

(10) Patent No.: US 8,350,776 B1
(45) Date of Patent: Jan. 8, 2013

(54) COMPACT DIRECTIONAL RECEIVING ANTENNA

(75) Inventor: Mark A. Bauman, College Place, WA (US)

(73) Assignee: Ensemble Solutions LLC, College Place, WA (US)

( * ) Notice: Subject to any disclaimer, the term of this patent is extended or adjusted under 35 U.S.C. 154(b) by 304 days.

(21) Appl. No.: 12/806,655

(22) Filed: Aug. 17, 2010

Related U.S. Application Data

(60) Provisional application No. 61/274,619, filed on Aug. 18, 2009.

(51) Int. Cl.
*H01Q 21/00* (2006.01)

(52) U.S. Cl. ..... 343/855; 343/866; 343/893

(58) Field of Classification Search ..... 343/853, 343/855, 857, 866, 874, 893
See application file for complete search history.

(56) References Cited

U.S. PATENT DOCUMENTS 1,336,398 A 4/1920 Weagant
1,471,165 A 10/1923 Israel
2,972,145 A 2/1961 Watts, Jr.
3,396,398 A 8/1968 Dunlavy, Jr.
4,325,141 A * 4/1982 Ghose ..... 455/63.1
2012/0026060 A1 * 2/2012 Hanazawa et al. ..... 343/853

OTHER PUBLICATIONS

Wellbrook Communications, Wellbrook Phased Array 500KHz to 2MHz,www.wellbrook.uk.com, PhasedArray.doc, Sep. 29, 2009.

* cited by examiner

*Primary Examiner* — Don Le
(74) *Attorney, Agent, or Firm* — Mark A. Bauman

(57) ABSTRACT

The present invention is a compact directional receiving antenna utilizing true-time-delay methods to achieve a wide pattern bandwidth and small real estate footprint. In one embodiment, two right-triangular-shaped loops are positioned in mirrored relation, one to another, with less than 1/100 wavelength spacing. In another embodiment, two of these pairs of loops are positioned in an orthogonal manner to form an electronically rotatable antenna array. In yet another embodiment, a single loop is provided with a pair of spaced couplers. Finally, in another embodiment, a pair of single loops is arranged in orthogonal relation to form an electronically rotatable array.

16 Claims, 14 Drawing Sheets

COMPACT DIRECTIONAL RECEIVING ANTENNA

CROSS-REFERENCES TO RELATED APPLICATIONS

This application claims priority to provisional application No. 61/274,619, filed on Aug. 18, 2009, the disclosures of which are incorporated herein.

TECHNICAL FIELD

The present invention relates to directional antennas, and more specifically to directional antennas that are compact in size relative to their wavelength.

BACKGROUND OF THE INVENTION

Directional antenna systems for receiving electromagnetic radiation have been practiced for many years. A variety of methods have been used to achieve varying degrees of success using terminated traveling wave antennas, phased arrays, parasitic arrays, and true-time delay arrays.

In practice, the antenna designer is often faced with a difficult tradeoff between complexity, gain, directivity, size and bandwidth. For example, for frequencies below 5 MHz, a terminated beverage antenna having a length of multiple wavelengths is known in the art to provide exemplary directivity over a wide bandwidth, but its size makes it difficult to deploy in many settings, especially when multiple antennas are required to achieve desired directional patterns. Rhombic antennas provide exceptional gain for a fixed pattern but also require significant support structure and real estate for effective operation. Curtain arrays provide moderate bandwidth and are moderate in real estate usage and require substantial investment in superstructure. Log Periodic arrays are known for their wide bandwidth and suitable directivity but also require significant investment in superstructure. Parasitic arrays are known for exceptional gain, excellent directivity, and moderate size, but require moderate superstructure and have a very small operational bandwidth.

Loop antennas are known in the art for providing a reliable bi-directional pattern for a relatively small size. It is well known that the signal from a loop antenna can be phased with a closely spaced vertical antenna element to achieve a cardiod pattern over a small bandwidth. In addition, including a properly selected and located resistor in series with a loop can provide a similar cardiod pattern. Other examples in the art include multiple loops in phased arrangement, being spaced apart in end fire relation.

Others have noted the value of utilizing a true-time-delay method of combining signals from two moderately spaced elements. For example, U.S. Pat. No. 3,396,398 issued to J. H. Dunlavy, Jr. teaches a two element true-time-delay antenna using a pair of shortened dipole elements separated by preferably less than 0.3 times the length of the shortest wavelength handled by the system. Such and antenna promises to provide exceptional bandwidth and reasonable directivity. However, the size of such an array is still considerable if, for example, if the shortest wavelength is twenty meters, the length of the dipole elements is six meters with a separation between elements of three meters.

The present invention provides a refreshing option for the antenna designer by providing a compact antenna having structural simplicity, acceptable gain, respectable directivity, fractional size, and exceptional bandwidth. For example, a single loop embodiment having a base length of seven meters provides an operational bandwidth of 0.5-14 MHz. A dual loop embodiment with each loop having individual base lengths of 3.5 meters each, and a separation distance of three centimeters provides an operational bandwidth of 1-22 MHz.

In addition, the nature of the arrangement of the loops and associated structure lends itself to configuring orthogonal arrays that can be electronically switched to provide means to rotate the pattern without physical rotation. These and other advantages the present invention will become apparent from a thorough review of this specification.

SUMMARY OF THE INVENTION

One aspect of the present invention is a compact directional antenna for receiving signals over a range of frequencies having respective wavelengths comprising a loop antenna element, a first coupler located at a first point, and configured to transfer signals from the loop antenna element, a first transmission line having a characteristic impedance, and a first end connected to the first coupler, and a second end, and operable to provide a first time delay for signals traveling from the first end to the second end, a second coupler located at a second point, and configured to transfer signals from the loop antenna element, a second transmission line having the characteristic impedance, and a first end connected to the second coupler, and a second end, and operable to provide a second time delay for signals traveling from the first end to the second end. The antenna further comprises a signal combiner having a first port having a first impedance, and coupled to the second end of the first transmission line, and a second port having the first impedance, and coupled to the second end of the second transmission line, and a third port, and wherein the signal combiner provides a third time delay for signals traveling from the first port to the third port, and wherein the signal combiner provides a fourth time delay for signals traveling from the second port to the third port.

Another aspect of the invention is a compact directional antenna for receiving signals over a range of frequencies having respective wavelengths comprising a first loop antenna element, a first coupler located at a first point, and configured to transfer signals from the loop antenna element, a first transmission line having a characteristic impedance, and a first end connected to the first coupler, and a second end, and operable to provide a first time delay for signals traveling from the first end to the second end, a second loop antenna element, a second coupler located at a second point, and configured to transfer signals from the second loop antenna element, a second transmission line having the characteristic impedance, and a first end connected to the second coupler, and a second end, and operable to provide a second time delay for signals traveling from the first end to the second end, and a signal combiner having a first port having a first impedance, and coupled to the second end of the first transmission line, and a second port having the first impedance, and coupled to the second end of the second transmission line, and a third port, and wherein the signal combiner provides a third time delay for signals traveling from the first port to the third port, and wherein the signal combiner provides a fourth time delay for signals traveling from the second port to the third port.

Yet another aspect of the invention is a compact directional antenna for receiving signals over a range of frequencies having respective wavelengths comprising a first, second, third, and fourth loop antenna elements, a first coupler located at a first point, and configured to transfer signals from the first loop antenna element, a second coupler located at a second point, and configured to transfer signals from the second loop antenna element, a third coupler located at a third point, and configured to transfer signals from the third loop antenna element, a fourth coupler located at a fourth point, and configured to transfer signals from the fourth loop antenna element, a first, second, third, and fourth transmission line, each having a characteristic impedance, and each having a first end connected to the respective first, second, third, and fourth coupler, and a second end, and operable to each provide a first time delay for signals traveling from the first end to the second end, a signal routing module having a first, second, third, and fourth ports each connected to the second end of the respective first, second, third, and fourth transmission lines, and a fifth port, and a sixth port, a fifth transmission line having a characteristic impedance equal to the characteristic impedance, and having a first end connected to the fifth port of the signal routing module, and operable to provide a second time delay for signals traveling from the first end to the second end, and a signal combiner having a first port having an impedance equal to a first impedance, and coupled to the second end of the fifth transmission line, and a second port having an impedance substantially equal to the first impedance, and coupled to the sixth port of the signal routing module, and a third port, and wherein the signal combiner provides a third time delay for signals traveling from the first port to the third port, and wherein the signal combiner provides a fourth time delay for signals traveling from the second port to the third port.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
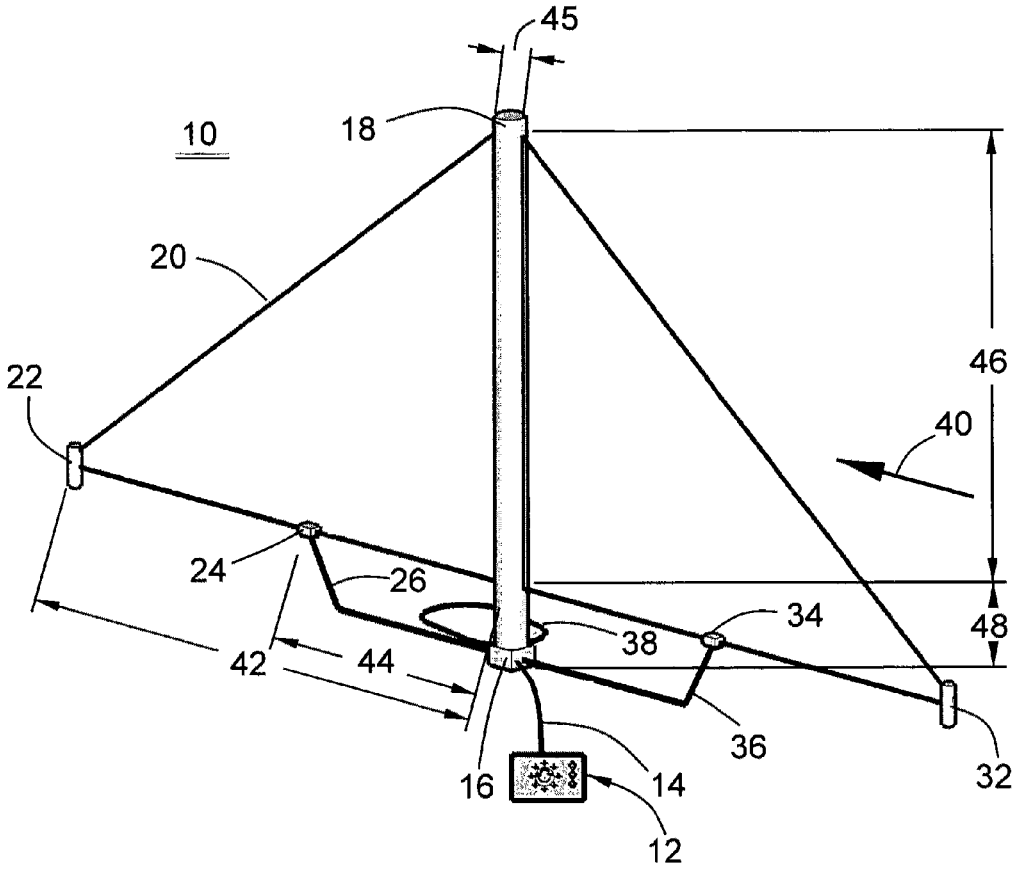
FIG. 1 is an isometric elevation view of a dual loop embodiment of the compact directional receiving antenna adapted for mounting on a horizontal surface.
Figure 2:
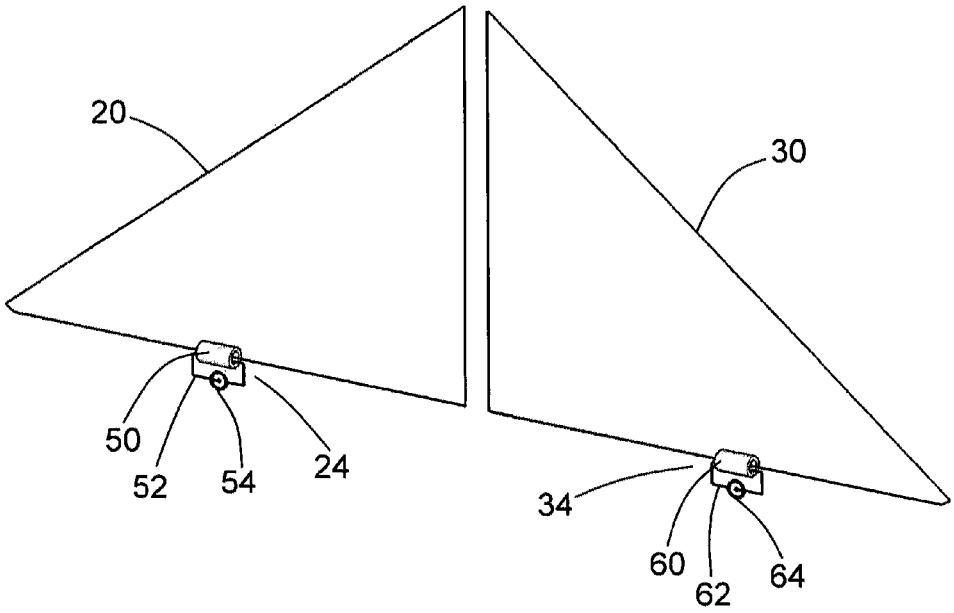
FIG. 2 is block diagram of dual loop antenna elements and associated antenna couplers.

Referring now to FIGS. 1 and 2, a dual loop embodiment of a compact directional receiving antenna 10 is illustrated in a fixed installation. The dual loop antenna 10 is shown in a ground mounted configuration, although it could be mounted above the ground without departing from the scope of this invention. The antenna 10 is also illustrated in a stationary configuration, although it can also be built in a mechanically rotatable configuration.

The dual loop antenna 10 includes a controller 12 that is provided to power and configure the dual loop antenna 10, and to transform and deliver captured signals to a receiver (not shown). A feed transmission line 14 connects to the controller 12, providing a conduit for signals captured from the antenna. In addition, the feed transmission line 14 can be utilized for transmitting power and data from the controller 12.

The feed transmission line 14 is connected to a signal processor 16 located near a base of the dual loop antenna 10. The signal processor 16 includes signal combining, time delay, impedance matching, and amplification circuitry as will be discussed in further detail in this specification.

The dual loop antenna 10 is shown including a vertically oriented center support 18 that is configured to provide a mechanical support. In a preferred embodiment, the center support 18 should be composed on non-conductive material. Additionally, other means of mechanical support may be employed without departing from the scope of this invention.

A first loop antenna element 20 is shown borne in part by the center support 18 and is comprised of an endless loop of wire that follows a path defining a shape, and having a path length and an enclosed area. In one embodiment, the shape defined by the element 20 is a right triangle. However, the element 20 may have other shapes without departing from the scope of the invention. In addition, the element 20 can be composed of other types of conductors including tubing, pipe, or printed circuit board traces. One end of first loop antenna element 20 is held in tension by an anchor 22.

A coupler 24 is positioned proximate to a portion of the loop antenna element 20 and is configured to transfer signals that are captured by the loop antenna element 20. In one embodiment, the coupler 24 is a current transformer formed by running the loop antenna element 20 directly through a single or multiple ferrite beads 50 (FIG. 2) forming a single turn primary winding of a current transformer. Other types of couplers known in the art, including active couplers, may also be used without departing from the scope of this invention.

A loop transmission line 26 is connected directly to the coupler 24. In one embodiment, the loop transmission line 26 is connected to a connector 54 (FIG. 2) that connects to a single turn secondary winding 52 (FIG. 2) of a current transformer formed by the ferrite bead 50 (FIG. 2). The loop transmission line 26 provides a time delay for signals traveling from one end to the other end.

A second loop antenna element 30 is shown also borne in part by the center support 18 and is comprised of an endless loop of wire. The path length and area enclosed of the loop antenna element 30 should closely approximate the path length and area enclosed of the loop element 20. Additionally, in one embodiment, the shape of the loop antenna element 30 is a mirror image of the shape of loop antenna element 20. The first and second loop antenna elements 20 and 30 respectively should be mounted in a common plane. One end of first loop antenna element 30 is held in tension by an anchor 32.

A coupler 34 is positioned proximate to a portion of the loop antenna element 30 and is configured to transfer signals that are captured by the loop antenna element 30 and should be substantially similar to the coupler 24. In one embodiment, the coupler 34 is a current transformer formed by running the loop antenna element 30 directly through a ferrite bead 60 (FIG. 2) forming a single turn primary winding of a current transformer.

A loop transmission line 36 is connected directly to the coupler 34. In one embodiment, the loop transmission line 36 is connected to a connector 64 (FIG. 2) that connects to a single turn secondary winding 62 (FIG. 2) of a current transformer formed by the ferrite bead 60 (FIG. 2). The loop transmission line 36 provides a time delay for signals traveling from one end to the other end, and in one embodiment provides a time delay that is substantially similar to the time delay provided the loop transmission line 26.

Referring to FIG. 1, a delay line 38 is formed by a transmission line and is shown having both ends connected to the signal processor 16 and introduces a time delay. The delay line 38 can also be formed using other elements as is known in the art without departing from the scope of this invention. The operation of the delay line 38 will be discussed in further detail later in this specification.

Signals coming from a reference direction generally indicated by the arrow 40 are preferred when signals from the loop transmission line 26 are routed through the delay line 38 before being combined with signals from loop transmission line 36.

The loop antenna elements 20 and 30 each have a similar loop base length 42, a coupler to center distance 44, and a loop apex height 46. The loop antenna elements 20 and 30 are separated by a loop spacing distance 45, and have a base height above ground 48. In one embodiment, when the dual loop antenna 10 is designed for an operational frequency range of 1-22 MHz, the loop base length 42 and loop apex height is equal to approximately 3.5 m, the coupler to center distance 44 is 1.75 m, the loop spacing distance 45 is 3 cm, and the base height above ground 48 is 20 cm.

Figure 3:
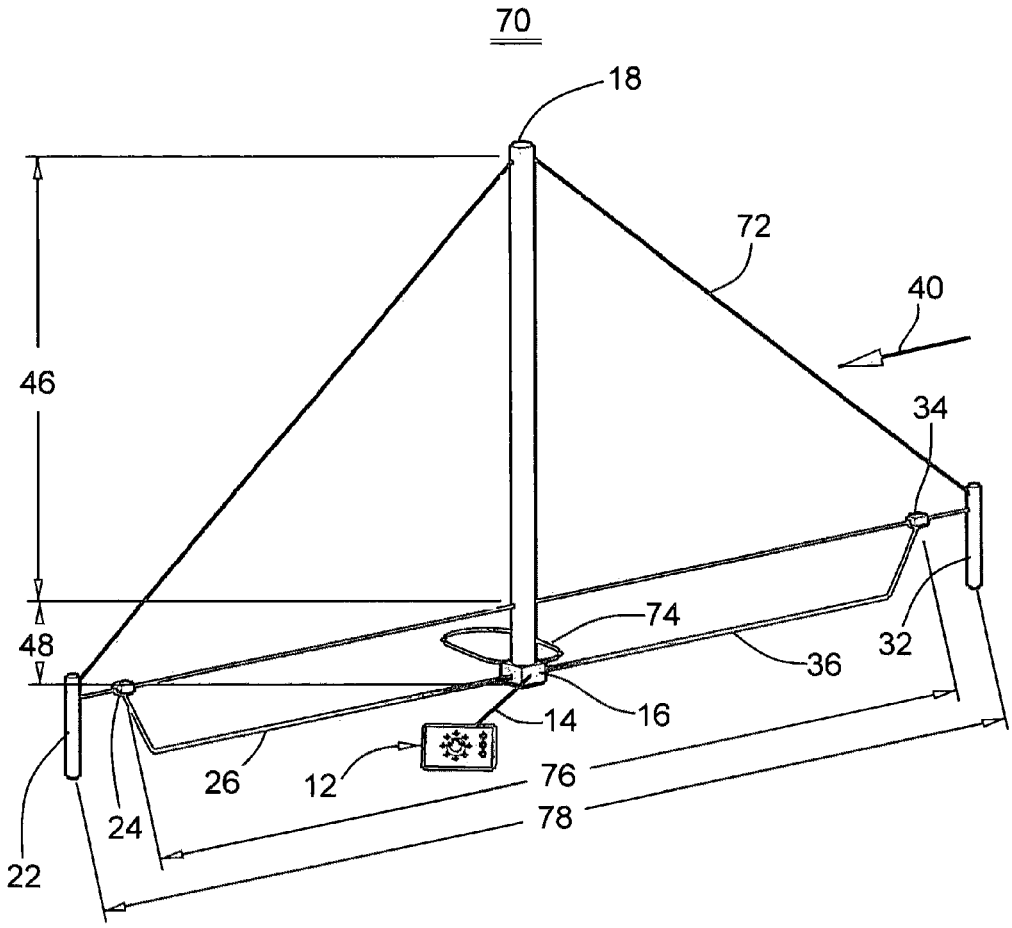
FIG. 3 is an isometric elevation view of a single loop embodiment of the compact directional receiving antenna apparatus adapted for mounting on a horizontal surface.
Figure 4:
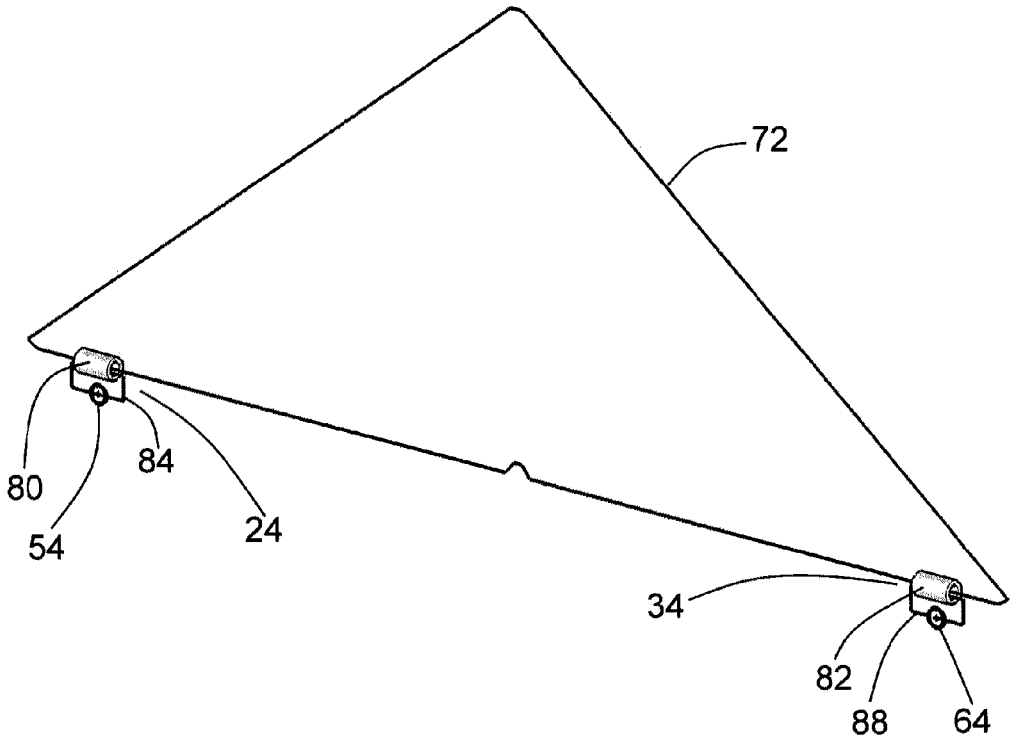
FIG. 4 is a block diagram of a single loop receiving antenna element and associated antenna couplers.

Referring now to FIGS. 3 and 4, a single loop embodiment of a compact directional receiving antenna 70 is illustrated in a fixed installation. The single loop antenna 70 is shown in a ground mounted configuration, although it could be mounted above the ground without departing from the scope of this invention.

The single loop antenna 70 includes the controller 12, feed transmission line 14, signal processor 16, and center support 18 as discussed above.

A single loop antenna element 72 is shown borne in part by the center support 18 and is comprised of an endless loop of wire that follows a path defining a shape, and having a path length and an enclosed area. In one embodiment, the shape defined by the element 20 is a triangle. However, the element 72 may have other, shapes without departing from the scope of the invention. In addition, the element 72 can be composed of other types of conductors including tubing, pipe, or a printed circuit board trace. Each corner of the single loop antenna element 72 is held in tension by the anchors 22 and 32.

The couplers 24 and 34 are positioned proximate to a portion of the loop antenna element 72. In one embodiment, the couplers 24 and 34 are each current transformers formed by running the loop antenna element 72 directly through ferrite beads 80 and 82 (FIG. 4) forming individual single turn primary windings.

The loop transmission lines 26 and 36 are each connected directly to the couplers 24 and 34. In one embodiment, the loop transmission lines 26 and 36 are connected to a connectors 54 and 640 (FIG. 4) that each in turn connect to separate single turn secondary windings 84 and 88 (FIG. 4) of current transformers formed by the ferrite beads 80 and 82 (FIG. 4). The loop transmission lines 26 and 36 each provide a time delay for signals traveling from one end to the other end.

Referring now to FIG. 3, the delay line 38 has both ends connected to the signal processor 16 introducing a time delay. Signals coming from a reference direction generally indicated by the arrow 40 are preferred when signals from the loop transmission line 26 are routed through the delay line 38 before being combined with signals from loop transmission line 36.

The single loop antenna element 72 has a loop base length 78, a coupler to coupler distance 76, a loop apex height 46, and the base height above ground 48. In one embodiment, when the single loop antenna 10 is designed for an operational frequency range of 500 KHz-14 MHz, the loop base length 78 is equal to 7 m, the loop apex height 46 is equal to approximately 3.5 m, the coupler to coupler distance 76 is 6 m, and the base height above ground 48 is 20 cm.

Figure 5:
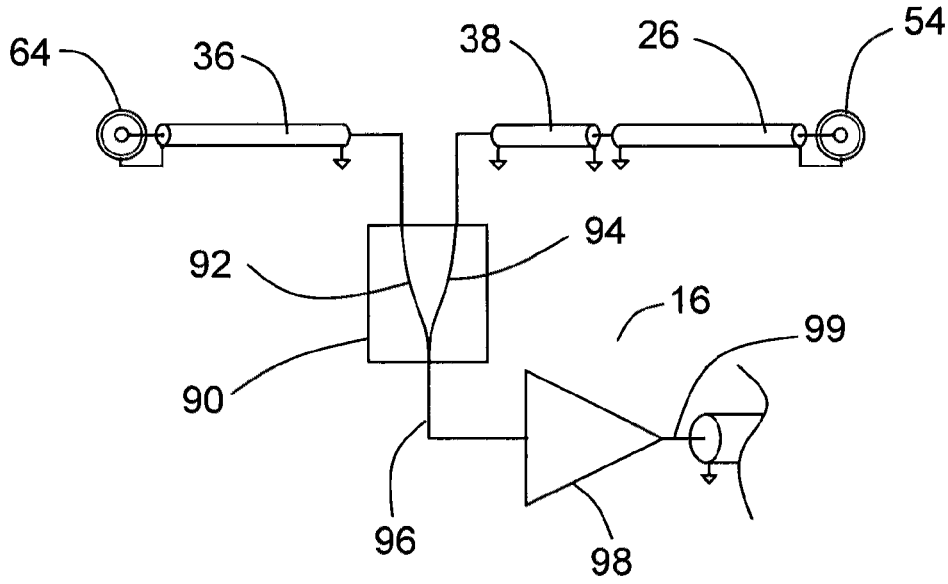
FIG. 5 is a block diagram of the transmission lines and signal processor utilized in various embodiments of the compact directional receiving antenna.

Referring now to FIG. 5, one end of the loop transmission line 36 is connected to the coupler connector 64. Another end of the loop transmission line 36 is connected to a first port of signal combiner 90. One end of transmission line 26 is connected to the coupler connector 54. Another end of the loop transmission line 26 is connected to a first end of the delay line 38. A second end of the delay line 38 is connected to a second port of the signal combiner 90. Within the signal combiner 90 there exists a first signal path 92 and a second signal path 94. As a practical matter, the first and second signal paths 92 and 94 each introduce signal time delays before signals are combined. Any significant inequality in time delay between the first and second signal paths 92 and 94 must be accounted for by adjusting the length or time delay of the delay line 38 to ensure proper operation. In addition, any inequality in time delay between the first and second signal paths 92 and 94 ideally should be stable over any desired operational frequency range. In one embodiment, the signal combiner 90 is a hybrid coupler having a characteristic impedance that matches the characteristic impedance of the loop transmission lines 26 and 36 as well as the delay line 38.

A combined signal 96 provided by the signal combiner 90 is introduced to a buffer amplifier 98. The buffer amplifier 98 should ideally have an input impedance over any desired operational frequency range that substantially matches the characteristic impedance of the loop transmission lines 26 and 35 as well as the delay line 38.

Figure 6:
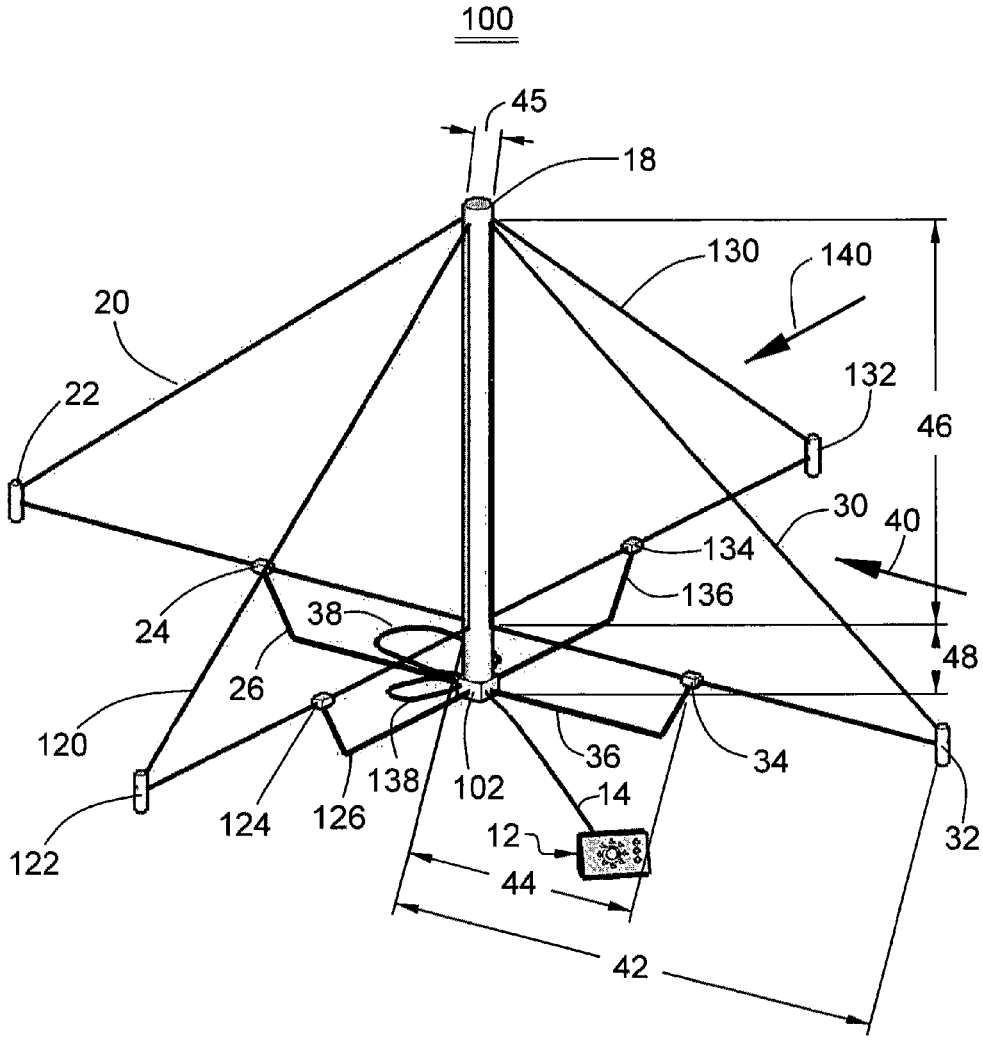
FIG. 6 is an isometric elevation view of a two orthogonal dual loop embodiment of the compact directional receiving antenna adapted for mounting on a horizontal surface.
Figure 7:
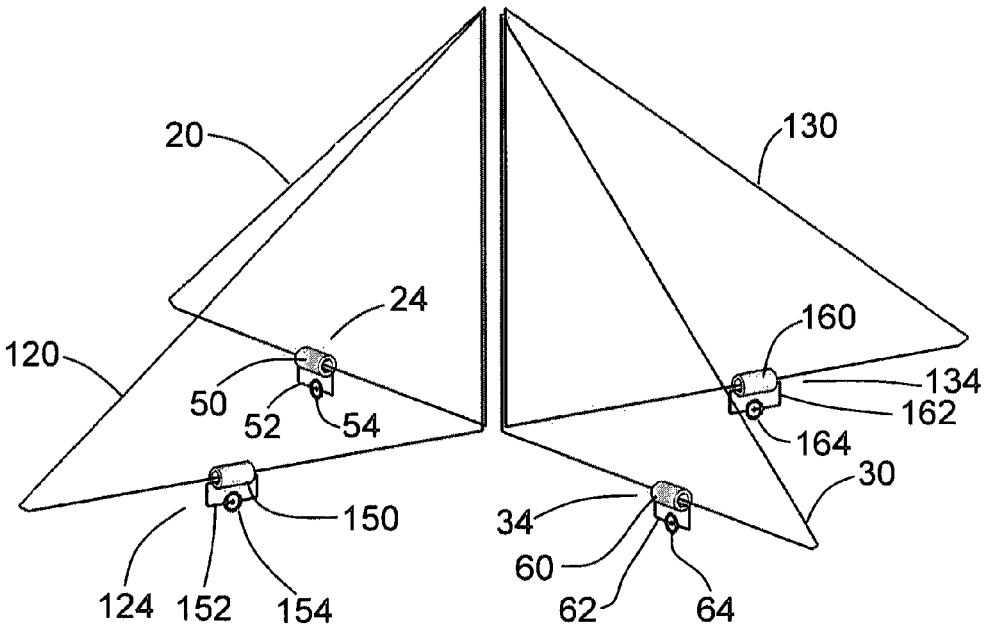
FIG. 7 is block diagram of a two orthogonal dual loop antenna elements and associated antenna couplers.

Referring now to FIGS. 6 and 7, an orthogonal dual loop embodiment of a compact directional receiving antenna 100 is illustrated in a fixed installation. The orthogonal dual loop antenna 100 is shown in a ground mounted configuration, and includes the controller 12, feed transmission line 14, and vertically oriented center support 18 as discussed previously in this specification. In this embodiment, the controller 12 is configured to electronically orient the antenna pattern as will be discussed later in this specification.

The feed transmission line 14 is connected to a signal processor 102 located near a base of the orthogonal dual loop antenna 100. The signal processor 102 includes switching, signal combining, time delay, impedance matching, and amplification circuitry as will be discussed in further detail in this specification.

The first loop antenna element 20, second loop antenna element 30, a third antenna element 120, and a fourth antenna element 130 are each borne in part by the center support 18 and are each comprised as discussed earlier. Each of the elements 20, 30, 120 and 130 have a path length and an area enclosed which should each be substantially equal to each other. Each of the elements 20, 30, 120 and 130 have a shape, and wherein the shape of element 30 and 130 should substantially mirror the shape of elements 20 and 120. The elements 20 and 30 should be mounted in a common plane and the elements 120 and 130 should be mounted in another plane that is substantially orthogonal to the common plane.

The loop antenna elements 20, 30, 120, and 130 are each held in tension by anchors 22, 32, 122 and 132 respectively.

The couplers 24 and 34 are each positioned proximate to a portion of the loop antenna element 20 and 30, and are each configured to transfer signals that are captured by the respective elements. Additional couplers 124 and 134 are similarly positioned proximate to a portion of the loop antenna elements 120 and 130, and are each configured to transfer signals that are captured by these respective elements in a manner described previously in this specification.

In one embodiment, the couplers 24, 34, 124 and 134 are each formed by routing each of the elements 20, 30, 120, and 130 through ferrite beads 50, 60, 150 and 160 as shown in FIG. 7. Secondary windings 52, 62, 152, and 152 are each provided to couple signals to connectors 54, 64, 154, and 164 (FIG. 7).

The loop transmission lines 26 and 36 are each connected directly to the couplers 24 and 34. Similarly, a transmission line 126 is connected to coupler 124 and a transmission line 136 is connected to coupler 134. Each of the transmission lines 26, 36, 126, and 136, provide a time delay for signals traveling from one end to the other end, and are selected to provide a substantially similar time delay, one with respect to another.

Referring now to FIG. 6, the delay line 38 is formed as discussed previously in this specification. Another delay line 138 is provided having both ends connected to the signal processor 16 and introduces another time delay. The delay line 138 can also be formed using other elements as is known in the art without departing from the scope of this invention. The operation of the delay line 138 will be discussed in further detail later in this specification.

Signals coming from a reference direction generally indicated by the arrow 40 are preferred when signals from the loop transmission line 26 are routed through the delay line 38 before being combined with signals from loop transmission line 36. Yet further, signals coming from a reference direction generally indicated by the arrow 140 are preferred when signals from the loop transmission line 126 are routed through the delay line 38 before being combined with signals from loop transmission line 136. Still further, signals coming from a reference direction generally indicated by a vector combination of the arrow 40 and 140 are preferred when signals from the loop transmission line 26 are combined with signals from loop transmission line 126, and are routed through the delay line 38 and delay line 138 before being finally combined with signals from a combination of signals from loop transmission line 36 and loop transmission line 136.

The loop antenna elements 20, 30, 120, and 130 each have a similar loop base length 42, a coupler to center distance 44, and a loop apex height 46. The loop antenna elements 20 and 30 are separated by a loop spacing distance 45. The loop antenna elements 120 and 130 are separated by the loop spacing distance 45. All of the loop antenna elements 20, 30, 120, and 130 share the base height above ground 48. In one embodiment, when the orthogonal dual loop antenna 100 is designed for an operational frequency range of 1-22 MHz, the loop base length 42 and loop apex height is equal to approximately 3.5 m, the coupler to center distance 44 is 1.75 m, the loop spacing distance 45 is 3 cm, and the base height above ground 48 is 20 cm.

Figure 8:
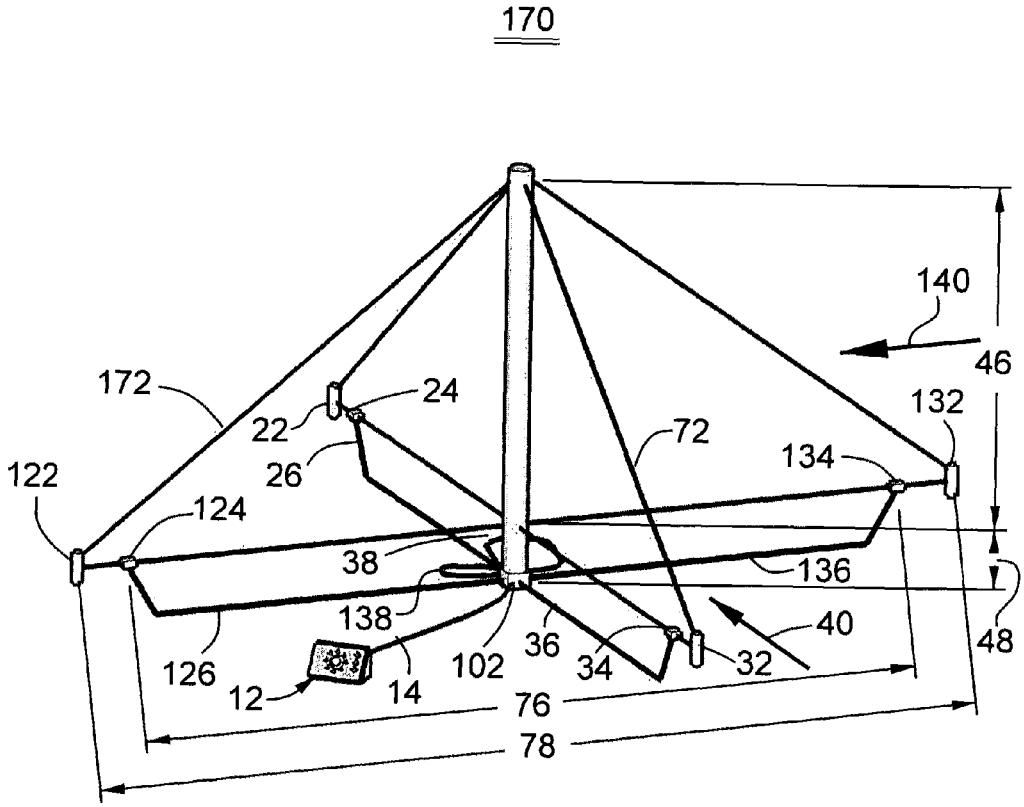
FIG. 8 is an isometric elevation view of a two orthogonal single loop embodiment of the compact directional receiving antenna adapted for mounting on a horizontal surface.
Figure 9:
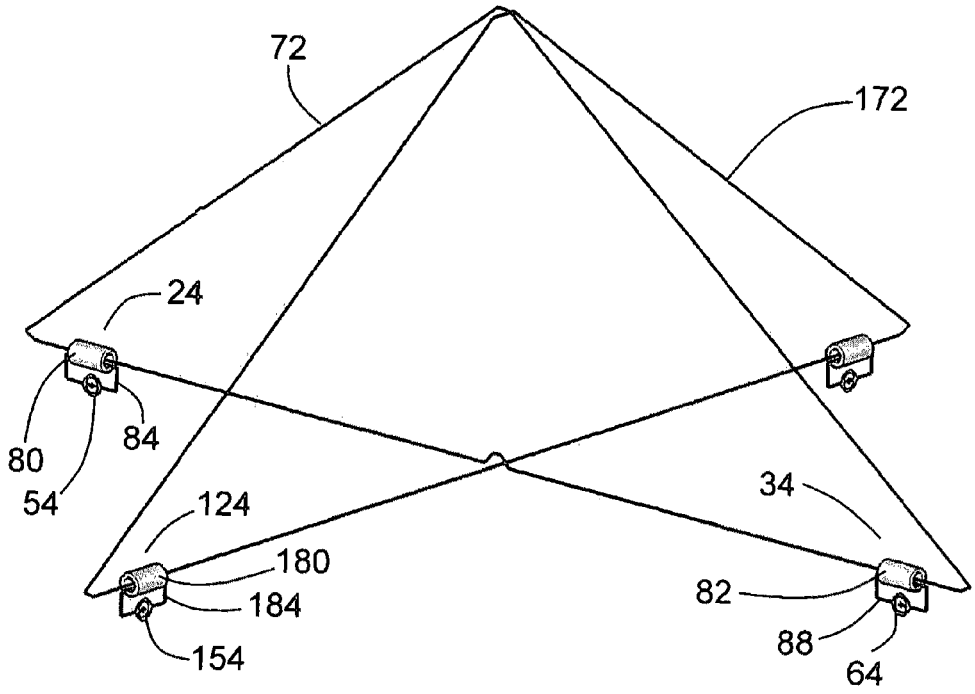
FIG. 9 is block diagram of a two orthogonal single loop antenna elements and associated antenna couplers.

Referring now to FIGS. 8 and 9, an orthogonal single loop compact directional receiving antenna 170 is illustrated in a fixed installation. The orthogonal single loop antenna 170 is shown in a ground mounted configuration, and includes the controller 12, feed transmission line 14, and vertically oriented center support 18 as discussed previously in this specification. In this embodiment, the controller 12 is configured to electronically orient the antenna pattern as will be discussed later in this specification.

The feed transmission line 14 is connected to the signal processor 102 located near a base of the orthogonal single loop antenna 170. The signal processor 102 includes switching, signal combining, time delay, impedance matching, and amplification circuitry as will be discussed in further detail in this specification.

The first loop antenna element 72 and a second loop antenna element 172 are each borne by the center support 18 and are each comprised as discussed earlier. Each of the elements 72 and 172 have a path length, shape, and an area enclosed which should each be substantially equal to one another. The element 72 is mounted in a common plane and the element 172 should be mounted in another plane that is substantially orthogonal to the common plane.

The loop antenna elements 72 and 172 are each held in tension by an anchors 22, 32, 122 and 132 respectively.

The couplers 24 and 34 are each positioned proximate to a portion of the loop antenna element 72 are each configured to transfer signals that are captured by the element. The couplers 124 and 134 are similarly positioned proximate to a portion of the loop antenna element 172 are each configured to transfer signals that are captured by this element in a manner described previously in this specification.

The couplers 24 and 34 are positioned proximate to a portion of the loop antenna element 72. In one embodiment, the couplers 24 and 34 are each current transformers formed by running the loop antenna element 72 directly through ferrite beads 80 and 82 (FIG. 9) forming individual single turn primary windings as discussed previously. The couplers 124 and 134 are positioned proximate to a portion of the loop antenna element 172. In one embodiment, the couplers 124 and 134 are each current transformers formed by running the loop antenna element 172 directly through ferrite beads 180 and 182 (FIG. 9) forming individual single turn primary windings as discussed previously.

The loop transmission lines 26 and 36 are each connected directly to the couplers 24 and 34. In one embodiment, the loop transmission lines 26 and 36 are connected to connectors 54 and 64 (FIG. 9) that each in turn connect to separate single turn secondary windings 84 and 88 (FIG. 9) of current transformers formed by the ferrite beads 80 and 82 (FIG. 9). Loop transmission lines 126 and 136 are each connected directly to the couplers 124 and 134 respectively. In one embodiment, the loop transmission lines 126 and 136 are connected to connectors 154 and 164 (FIG. 9) that each, in turn, connect to separate single turn secondary windings 184 and 188 (FIG. 9) of current transformers formed by the ferrite beads 180 and 182 (FIG. 9).

The loop transmission lines 26 and 36 are each connected directly to the couplers 24 and 34. Similarly, a transmission line 126 is connected to coupler 124 and a transmission line 136 is connected to coupler 134. Each of the transmission lines 26, 36, 126, and 136 provide a time delay for signals traveling from one end to the other end, and are selected to provide a substantially similar time delay one with respect to another.

Referring now to FIG. 8, the delay lines 38 and 138 are formed and connected as discussed previously in this specification. The operation of the delay line 138 will be discussed in further detail later in this specification.

Signals coming from a reference direction generally indicated by the arrow 40 are preferred when signals from the loop transmission line 26 are routed through the delay line 38 before being combined with signals from loop transmission line 36. Yet further, signals coming from a reference direction generally indicated by the arrow 140 are preferred when signals from the loop transmission line 126 are routed through the delay line 38 before being combined with signals from loop transmission line 136. Still further, signals coming from a reference direction generally indicated by a vector combination of the arrow 40 and 140 are preferred when signals from the loop transmission line 26 are combined with signals from loop transmission line 126, and are routed through the delay line 38 and delay line 138 before being finally combined with signals from a combination of signals from loop transmission line 36 and loop transmission line 136 as discussed previously.

The antenna elements 72 and 172 each have the loop base length 78, the coupler to coupler distance 76, the loop apex height 46, and the base height above ground 48. In one embodiment, when the single loop antenna 170 is designed for an operational frequency range of 500 KHz-14 MHz, the loop base length 78 is equal to 7 m, the loop apex height 46 is equal to approximately 3.5 m, the coupler to coupler distance 76 is 6 m, and the base height above ground 48 is 20 cm.

Figure 10:
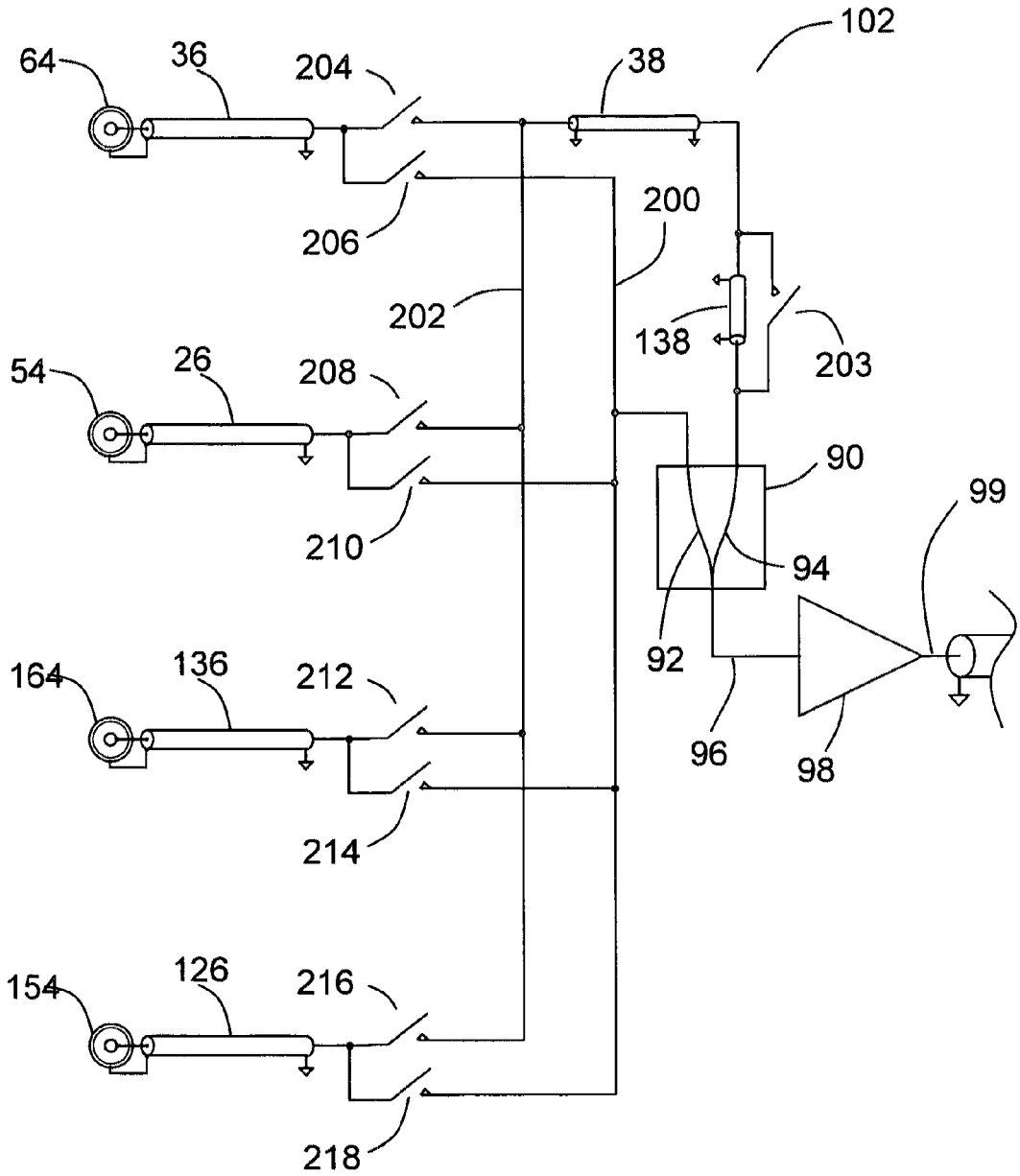
FIG. 10 is a block diagram of the transmission lines and signal processor utilized in selected embodiments of the compact directional receiving antenna.

Referring now to FIG. 10, a combiner signal bus 200 is connected to a first port of the signal combiner 90. A delay line signal bus 202 is connected to a first end of the delay line 38. A second end of the delay line 38 is connected to a first end of a parallel combination of the delay line 138 and a bypass switch 203. An opposite end of the parallel combination is connected to a second port of the signal combiner 90.

The combined signal 96 provided by the signal combiner 90 is introduced to the buffer amplifier 98. The resultant signal 99 is provided by the buffer amplifier 98.

A first end of the transmission line 36 is coupled to the connector 64. A controlled connection is provided between a second end of the transmission line 36 and the delay line signal bus 202 via switch 204. A controlled connection is also provided between the second end of the transmission line 36 and the combiner signal bus 202 via switch 206.

A first end of the transmission line 26 is coupled to the connector 54. A controlled connection is provided between a second end of the transmission line 26 and the delay line signal bus 202 via switch 208. A controlled connection is provided between the second end of the transmission line 26 and the combiner signal bus 202 via switch 210.

A first end of the transmission line 136 is coupled to the connector 164. A controlled connection is further provided between a second end of the transmission line 136 and the delay line signal bus 202 via switch 212. A controlled connection is also provided between the second end of the transmission line 136 and the combiner signal bus 202 via switch 214.

A first end of the transmission line 126 is coupled to the connector 154. A controlled connection is provided between a second end of the transmission line 126 and the delay line signal bus 202 via switch 216. A controlled connection is provided between the second end of the transmission line 126 and the combiner signal bus 202 via switch 218.

A preferred receive direction can be manipulated for both the orthogonal dual loop antenna 100 (FIG. 6) and the orthogonal single wire loop antenna 170 (FIG. 8) by proper configuration of the switches 203, 204, 206, 208, 210, 21, 214, 216, and 218. This arrangement will be discussed in further detail in the operation portion of this specification.

In one embodiment of the orthogonal dual loop antenna 100 (FIG. 6), the combiner first signal path 92 provides a time delay of 6 nsec relative to the combiner second signal path 94. In this embodiment, delay line 38 is selected to provide a 20 nsec delay and delay line 138 is selected to provide a 6 nsec delay. As a result, a delay of 14 nsec is realized when the bypass switch 203 is closed, and a delay of 20 nsec is realized when the bypass switch 203 is open. Using these values, an acceptable front-to-back ratio has been achieved using the dimensions provided earlier in this specification.

In one embodiment of the orthogonal single loop antenna 170 (FIG. 8), the combiner first signal path 92 provides a time delay of 6 nsec relative to the combiner second signal path 94 as discussed above. In this embodiment, delay line 38 is selected to provide a 27 nsec delay and delay line 138 is selected to provide a 8 nsec delay. As a result, a delay of 21 nsec is realized when the bypass switch 203 is closed, and a delay of 29 nsec is realized when the bypass switch 203 is open. Using these values, an acceptable front-to-back ratio has been achieved using the dimensions provided earlier in this specification.

Figure 11:
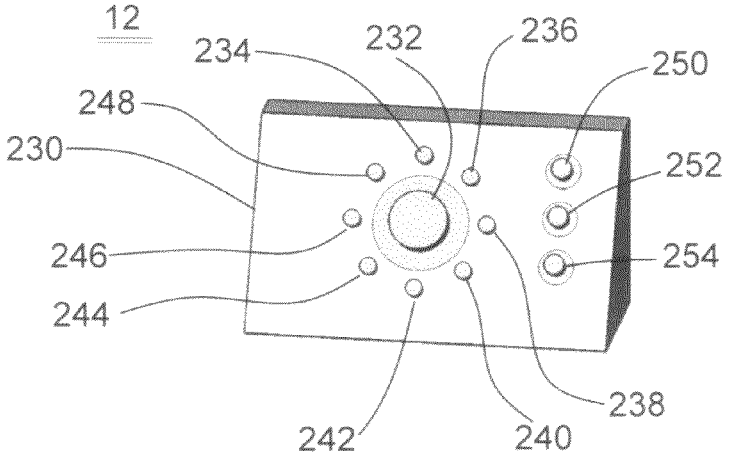
FIG. 11 is an isometric elevation view of a controller utilized in a directional receiving antenna.

Referring now to FIG. 11 the controller 12 is housed in an enclosure 230 which supports a selector switch 232. The selector switch 232 is configured to specify a direction by rotating a knob attached thereto. A plurality of light emitting diodes are arranged about the selector switch 230 and are herein referenced as a north LED 234, a northeast LED 236, a east LED 238, a southeast LED 240, a south LED 242, a southwest LED 244, and west LED 246, and a northwest LED 248.

A pattern flip push button switch 250 is mounted on the enclosure 230 and is configured to temporarily change a configuration of the signal processor 102 to electronically rotate a response of the antenna 100 or 170 by one-hundred-eighty degrees.

A unidirectional push button switch 252 is configured to command the signal processor 102 to provide a response of the antenna 100 or 170 that is generally unidirectional. A bidirectional push button 254 is configured to command the signal processor 102 to provide a response of the antenna 100 or 170 that is generally bidirectional.

Figure 12:
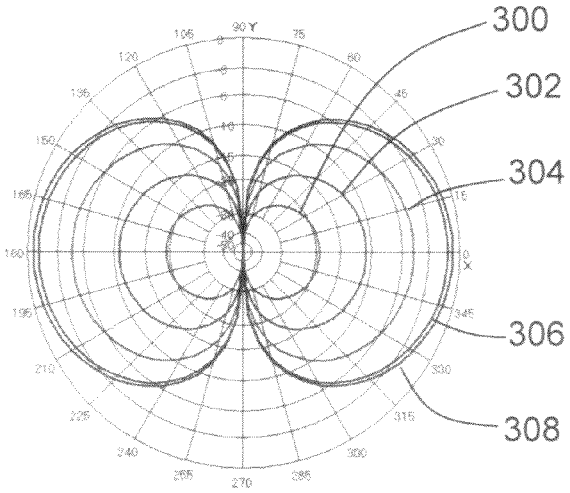
FIG. 12 is a collection of horizontal response patterns for a loop antenna element at selected operational frequencies.

Referring now to FIG. 12, and using the dimensions described earlier, a series of patterns is provided illustrating relative performance of both the antenna 100 or 170 when they are configured to provide a bidirectional response. The pattern generally indicated by the numeral 300 is modeled at a frequency of 1.5 MHz; the pattern generally indicated by the numeral 302 is modeled at a frequency of 3 MHz; the pattern generally indicated by the numeral 304 is modeled at a frequency of 6 MHz; the pattern generally indicated by the numeral 306 is modeled at a frequency of 12 MHz; and the pattern generally indicated by the numeral 308 is modeled at a frequency of 18 MHz.

Figure 13:
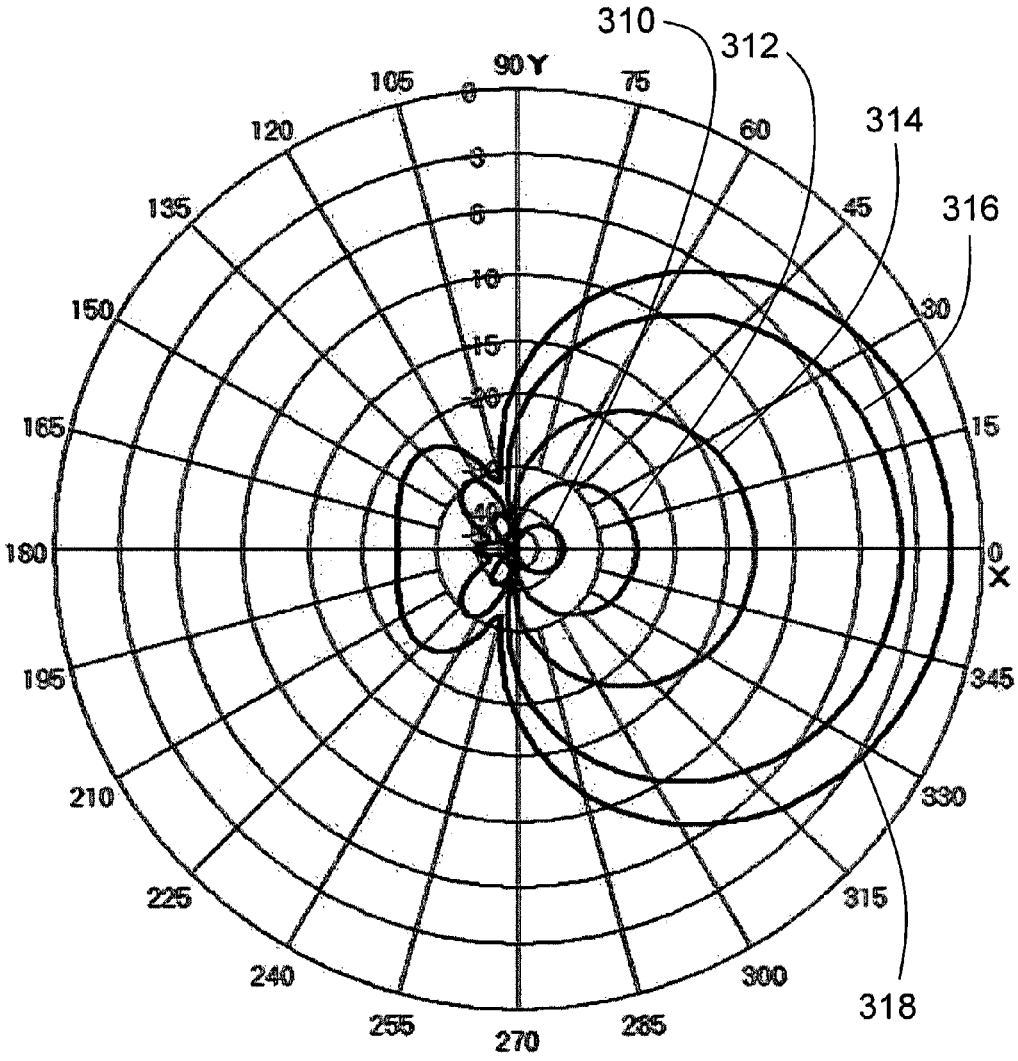
FIG. 13 is a collection of horizontal response patterns for a dual loop embodiment of the compact directional receiving antenna at selected operational frequencies.

Referring now to FIG. 13, and using the dimensions described earlier for the dual loop antenna 10 and orthogonal dual loop antenna 100, a series of patterns is provided when the antenna 100 configured to provide a unidirectional response. The pattern generally indicated by the numeral 310 is modeled at a frequency of 1.5 MHz; the pattern generally indicated by the numeral 312 is modeled at a frequency of 3 MHz; the pattern generally indicated by the numeral 314 is modeled at a frequency of 6 MHz; the pattern generally indicated by the numeral 316 is modeled at a frequency of 12 MHz; and the pattern generally indicated by the numeral 318 is modeled at a frequency of 18 MHz.

Figure 14:
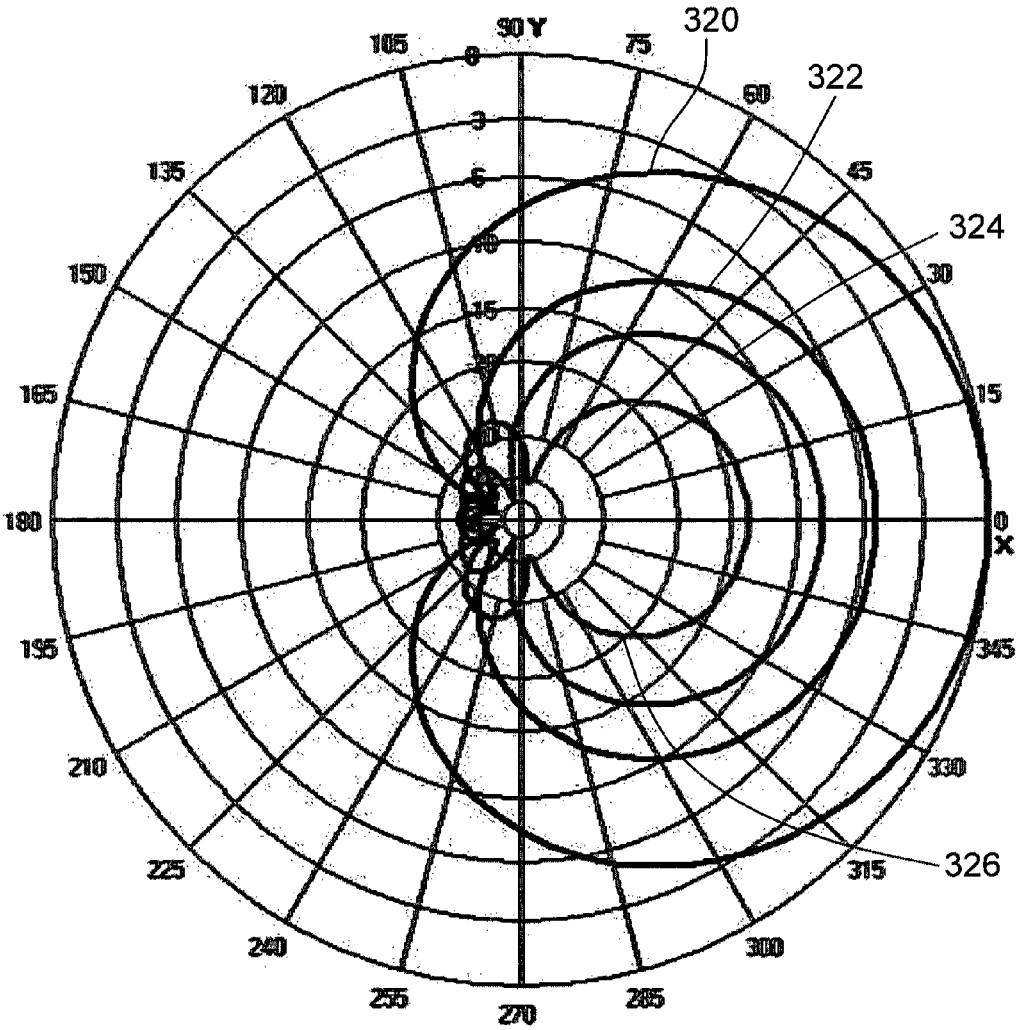
FIG. 14 is a collection of horizontal response patterns for a dual loop embodiment of the compact directional receiving antenna at selected coupling locations for a given frequency.

Referring now to FIGS. 1, 6, and 14, and using the overall dimensions described earlier for the orthogonal dual loop antenna 100, a relative position of the coupler distance to center 44 to the loop base length 42 impacts the shape of the antenna pattern and will be described briefly below. There is also a relationship between the coupler distance to center 44 and the optimum delay line 38 length. The series of patterns are illustrated for a frequency of 6 MHz, although the pattern shape is largely retained over the operational frequencies. The pattern generally indicated by the numeral 320 is modeled when the coupler distance to center 44 is 90% of the loop base length 42; the pattern generally indicated by the numeral 322 is modeled when the coupler distance to center 44 is 50% of the loop base length 42; the pattern generally indicated by the numeral 324 is modeled when the coupler distance to center 44 is 37% of the loop base length 42; and the pattern generally indicated by the numeral 326 is modeled when the coupler distance to center 44 is 29% of the loop base length 42. By inspection of FIG. 14, it is apparent that forward gain is increased as the coupler distance to center percentage is increased at the expense of front to side ratio.

Figure 15:
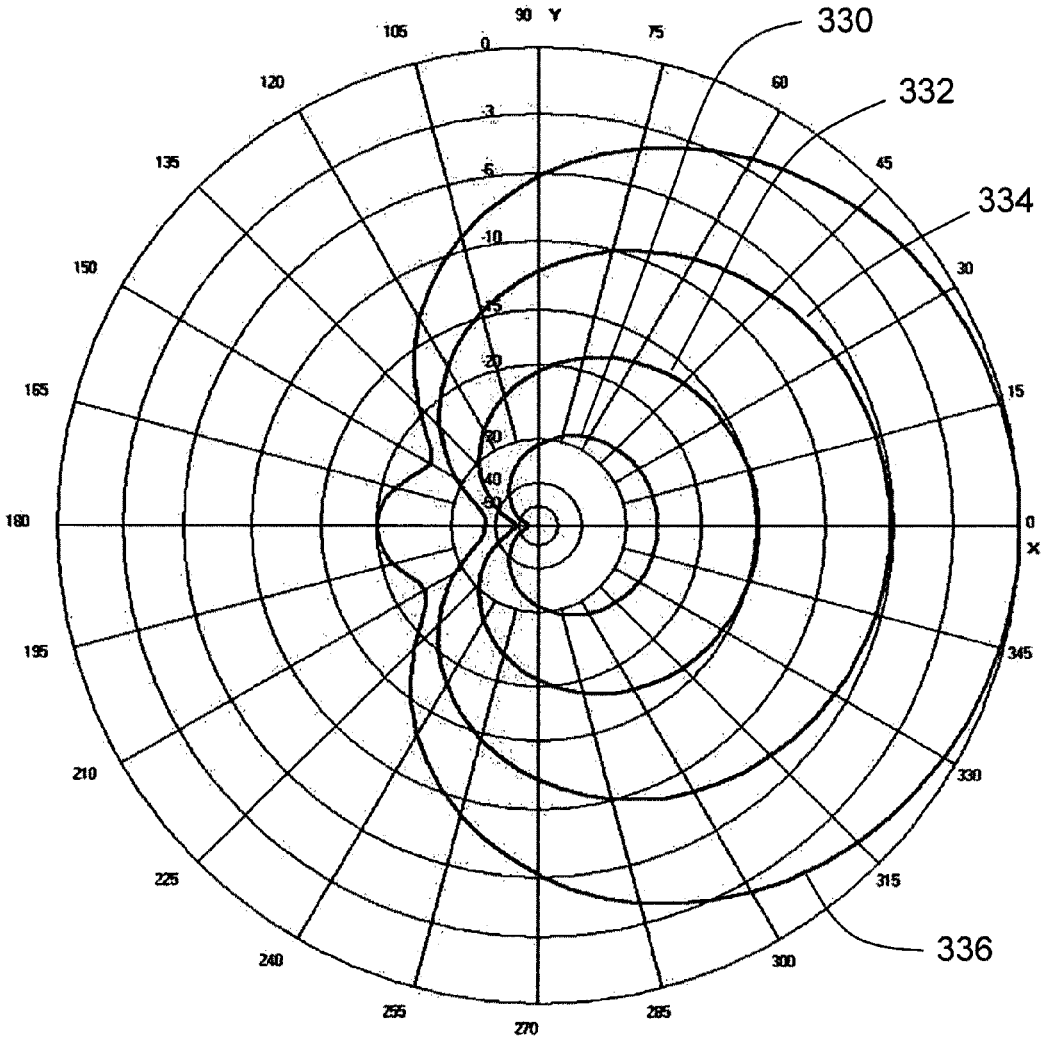
FIG. 15 is a collection of horizontal response patterns for a single loop embodiment of the compact directional receiving antenna at selected operational frequencies.

Referring now to FIG. 15, and using the dimensions described earlier for the single loop antenna 10 and orthogonal single loop antenna 170, a series of patterns is provided when the antenna 170 configured to provide a unidirectional response. The pattern generally indicated by the numeral 330 is modeled at a frequency of 1.5 MHz; the pattern generally indicated by the numeral 332 is modeled at a frequency of 3 MHz; the pattern generally indicated by the numeral 334 is modeled at a frequency of 6 MHz; and the pattern generally indicated by the numeral 336 is modeled at a frequency of 12 MHz.

Operation

The operation of the present invention is believed to be readily apparent and is briefly summarized in the paragraphs which follow.

Referring to FIGS. 1,2 and 5, an electromagnetic signal arriving from a direction opposite indicated by the arrow 40 will first induce a signal into loop element 20, and then, after an induced arrival time delay, into loop element 30. Each of the loop elements 20 and 30 have a individual response pattern which is represented by the patterns shown in FIG. 12 at selected frequencies as discussed above. The loop coupler 24 will transfer its signal in phased relationship from loop element 20 to the transmission line 26 and the loop coupler 34 will transfer its signal in phased relationship from the loop element 30 to the transmission line 36. Each signal experiences a similar time delay when traveling from one end of the transmission lines 26 and 36 if they each have a similar length, velocity factor, characteristic impedance, and are terminated into a similar impedance, which most desirably, is the characteristic impedance of the transmission line. Since this is the case, the delay experienced through the transmission lines 26 and 36 will be substantially similar.

After traveling through transmission line 26, its signal is routed through delay line 38 to induce a further delay into the signal received on the loop element 20. The delay line 38 is terminated into one port of the signal combiner 90 where it experiences a further delay through the combiner signal path 94. The transmission line 36 is terminated into another port of the signal combiner 90 where it experiences a further delay through the combiner signal path 92. The combined signal 96 emerges from a third port of the combiner 90 and is routed to the buffer amplifier 98, where it is delivered to the feed transmission line 14 via path 99. The controller 12 conditions the signal provided by the transmission line 14 and makes it available for connection to a receiver (not shown). The controller 12 also provides power for the buffer amplifier 98.

During design of the antenna 10, the phasing of the couplers as well as the time delay induced by each line and signal path is selected such that signals arriving from the direction opposite that indicated by the arrow 40 are of opposite phase so that they effectively cancel, allowing signals arriving from the preferred direction indicated by arrow 40 to experience a lesser degree of cancellation. More specifically, the sum of the delay provided by the transmission line 26 and the delay line 38 and the signal path delay 94 minus the sum of the delay provided by the transmission line 36 and the signal path delay 92 should be approximately equal to the induced arrival time delay. The results of the signal combining process can be observed by a careful inspection of FIGS. 13 and 14 as described previously in this specification.

Referring now to FIGS. 6, 7, 10, and 11, elements of one dual loop antenna 10 (FIG. 1) are oriented in a direction generally indicated by the arrow 40 (which follows signals arriving from a northerly direction), and combined in orthogonal fashion with elements of another dual loop antenna 10 (FIG. 1) and oriented in a direction generally indicated by the arrow 140 (which follows signals arriving from an westerly direction) for form an orthogonal dual loop antenna 100.

The signal processor 102 is configured to be responsive to commands provided by the controller 12 as is well known in the art. When the bidirectional push button 254 is pressed, a pair of oppositely positioned light emitting diodes are lit indicating the commanded direction. When the north LED 234 and south LED 242 are each illuminated, a message is sent to the signal processor 102 to close the combiner switch 206, leaving remaining switches in FIG. 10 in an open position. Signals arriving at the antenna 100 are induced into loop element 30, where they are coupled into the transmission line 36 via coupler 34. These signals are routed through the closed combiner switch 206 and travel through the combiner 90 and follow the path discussed previously in this specification. Since all other switches in the signal processor 102 remain open, no other signal is presented to the combiner 90, so the pattern of FIG. 12 is realized with a north-south orientation. In a similar manner, by moving the selector switch 232 so that the east LED 238 and west LED 246 are illuminated, a message is sent from the controller 12 to the signal processor 102 to close combiner switch 218 leaving remaining switches in FIG. 10 in an open position so the pattern of FIG. 12 is realized with a east-west orientation.

By moving the selection switch 232 so that the northeast LED 236 and southwest LED 244 are each illuminated, a message is sent to the signal processor 102 to close the switches 206 and 218, leaving remaining switches in FIG. 10 in an open position. Signals arriving at the antenna 100 are induced into loop elements 30 and 120, where they are each coupled into the transmission lines 36 and 126 via couplers 34 and 124. These signals are routed through the closed combiner switches 206 and 218 to the combiner signal bus 200, traveling through the combiner 90 and following the path discussed previously in this specification. Since all other switches in the signal processor 102 remain open, no other signal is presented to the combiner 90, so the pattern of FIG. 12 is realized with a northeast-southwest orientation.

In a similar manner, by moving the selector switch 232 so that the southeast LED 240 and northwest LED 248 are illuminated, a message is sent from the controller 12 to the signal processor 102 to close combiner switches 210 leaving remaining switches in FIG. 10 in an open position so the pattern of FIG. 12 is realized with a southeast-northwest orientation.

Continuing to refer to FIGS. 6, 7, 10, and 11, when the unidirectional push button 252 is pressed, a light emitting diode is lit indicating the commanded direction. When only the north LED 234 is illuminated, a message is sent to the signal processor 102 to close the switches 206, 208 and the bypass switch 203, leaving remaining switches in FIG. 10 in an open position. The signal arriving at the antenna 100 is induced into loop element 30, where it is coupled into the transmission line 36 via coupler 34. This signal is routed through the closed combiner switch 206 and fed onto the combiner signal bus 200 that is also connected to the combiner 90. The signal is also induced into the loop element 20, where it is coupled into the transmission line 26 via coupler 24. The signal is routed through the closed delay switch 208 and fed onto the delay line signal bus 202 that is connected to the delay line 38 that subsequently is connected to the bypass switch 203 that is also connected to the combiner 90. At the combiner, signals coming from the favored direction are attenuated less than are signals coming from the un-favored direction as discussed previously in this specification. In this way, the antenna patterns shown in FIG. 13 and FIG. 14 are realized with a northerly orientation.

In a similar manner, by moving the selector switch 232 so that the south LED 242 is illuminated, a message is sent from the controller 12 to the signal processor 102 to close the switches 210, 204 and the bypass switch 203, leaving remaining switches in FIG. 10 in an open position. In this way, the antenna patterns shown in FIG. 13 and FIG. 14 are realized with a southerly orientation.

By rotating the selector switch 232 so that the east LED 238 is illuminated, a message is sent to the signal processor 102 to close the switches 218, 212 and the bypass switch 203, leaving remaining switches in FIG. 10 in an open position. The signal arriving at the antenna 100 is induced into loop element 120, where it is coupled into the transmission line 126 via coupler 124. This signal is routed through the closed combiner switch 218 and fed onto the combiner signal bus 200 that is also connected to the combiner 90. The signal is also induced into the loop element 130, where it is coupled into the transmission line 136 via coupler 134. The signal is routed through the closed delay switch 212 and fed onto the delay line signal bus 202 that is connected to the delay line 38 that subsequently is connected to the bypass switch 203 that is also connected to the combiner 90. At the combiner, signals coming from the favored direction, in this case from the east, are attenuated less than are signals coming from the un-favored direction as discussed previously in this specification. In this way, the antenna patterns shown in FIG. 13 and FIG. 14 are realized with an easterly orientation.

In a similar manner, by rotating the selector switch 232 so that the west LED 246 is illuminated, a message is sent from the controller 12 to the signal processor 102 to close the switches 214, 216 and the bypass switch 203, leaving remaining switches in FIG. 10 in an open position. In this way, the antenna patterns shown in FIG. 13 and FIG. 14 are realized with a westerly orientation.

Referring still to FIGS. 6, 7, 10, and 11 and by moving the selection switch 232 so that the northeast LED 236 is illuminated, a message is sent, to the signal processor 102 to close the combiner switches 206, 218 and delay switches 208 and 212 leaving remaining switches in FIG. 10 in an open position. Signals arriving at the antenna 100 are induced into loop elements 30 and 120, where they are each coupled into the transmission lines 36 and 126 via couplers 34 and 124. These signals are routed through the closed combiner switches 206 and 218 to the combiner signal bus 200, traveling through the combiner 90 and following the path discussed previously in this specification.

Signals arriving at the antenna 100 are also induced into loop elements 20 and 130, where they are each coupled into the transmission lines 26 and 136 via couplers 24 and 134. These signals are routed through the closed delay switches 208 and 212 and fed onto the delay line signal bus 202 that is connected to the delay line 38 that subsequently is connected to the delay line 138 that is also connected to the combiner 90. At the combiner, signals coming from the favored direction, in this case from the northeast, are attenuated less than are signals coming from the un-favored direction as discussed previously in this specification. In practice, it has been found that the delay line 138 is optional, and can be removed if it is permanently bypassed.

In a similar manner, by moving the selector switch 232 so that the southeast LED 240 is illuminated, a message is sent from the controller 12 to the signal processor 102 to close combiner switches 210 and 218 and close delay switches 204 and 212 leaving remaining switches in FIG. 10 in an open position. In this configuration signals coming from the favored direction, in this case from the southeast, are attenuated less than are signals coming from the un-favored direction as discussed previously in this specification.

Also, in a similar manner, by moving the selector switch 232 so that the southwest 244 is illuminated, a message is sent from the controller 12 to the signal processor 102 to close combiner switches 210 and 214 and close delay switches 204 and 216 leaving remaining switches in FIG. 10 in an open position. In this configuration signals coming from the favored direction, in this case from the southwest, are attenuated less than are signals coming from the un-favored direction as discussed previously in this specification.

Finally, in a similar manner, by moving the selector switch 232 so that the northwest 244 is illuminated, a message is sent from the controller 12 to the signal processor 102 to close combiner switches 206 and 214 and close delay switches 208 and 216 leaving remaining switches in FIG. 10 in an open position. In this configuration signals coming from the favored direction, in this case from the northwest, are attenuated less than are signals coming from the un-favored direction as discussed previously in this specification.

Referring now to FIGS. 3, 4 and 5, an electromagnetic signal arriving from a direction opposite indicated by the arrow 40 will induce a signal into loop element 72. The loop elements 72 each have an individual response pattern that is represented by the patterns shown in FIG. 12 at selected frequencies discussed above.

The signal from the loop element 72 will first transfer the signal to loop coupler 24, and then, after an induced arrival time delay, transfer the signal to loop coupler 34. Accordingly, the loop coupler 24 will transfer its signal in phased relationship to the transmission line 26, and the loop coupler 34 will transfer its signal in phased relationship to the transmission line 36.

After traveling through transmission line 26, its signal is routed through delay line 38 to induce a further delay into the signal received on the loop element 20. The delay line 38 is terminated into one port of the signal combiner 90 where it experiences a further delay through the combiner signal path 94. The transmission line 36 is terminated into another port of the signal combiner 90 where it experiences a further delay through the combiner signal path 92. The combined signal 96 emerges from a third port of the combiner 90 and is routed to the buffer amplifier 98, where it is delivered to the feed transmission line 14 via path 99. The controller 12 conditions the signal provided by the transmission line 14 and makes it available for connection to a receiver (not shown). The controller 12 also provides power for the buffer amplifier 98.

During design of the antenna 10, the phasing of the couplers as well as the time delay induced by each line and signal path is selected such that signals arriving from the direction opposite that indicated by the arrow 40 are of opposite phase so that they effectively cancel, allowing signals arriving from the preferred direction indicated by arrow 40 to experience a lesser degree of cancellation. More specifically, the sum of the delay provided by the transmission line 26 and the delay line 38 and the signal path delay 94 minus the sum of the delay provided by the transmission line 36 and the signal path delay 92 should be approximately equal to the induced arrival time delay. The results of the signal combining process can be observed by a careful inspection of FIG. 15 as described previously in this specification.

Referring now to FIGS. 8, 9, 10, and 11, elements of one single loop antenna 70 (FIG. 3) are oriented in a direction generally indicated by the arrow 40 (which follows signals arriving from a northerly direction), and combined in orthogonal fashion with elements of another single loop antenna 70 (FIG. 3) and oriented in a direction generally indicated by the arrow 140 (which follows signals arriving from an westerly direction) to form an orthogonal single loop antenna 170.

When the bidirectional push button 254 is pressed, a pair of oppositely positioned light emitting diodes are lit indicating the commanded direction. When the north LED 234 and south LED 242 are each illuminated, a message is sent to the signal processor 102 to close the combiner switch 206, leaving remaining switches in FIG. 10 in an open position. Signals arriving at the antenna 170 are induced into loop element 72, where they are coupled and routed as described earlier in this specification so the pattern of FIG. 12 is realized with a north-south orientation. In a similar manner, by moving the selector switch 232 so that the east LED 238 and west LED 246 are illuminated, a message is sent from the controller 12 to the signal processor 102 to close combiner switch 218 leaving remaining switches in FIG. 10 in an open position so the pattern of FIG. 12 is realized with a east-west orientation.

By moving the selection switch 232 so that the northeast LED 236 and southwest LED 244 are each illuminated, a message is sent to the signal processor 102 to close the switches 206 and 218, leaving remaining switches in FIG. 10 in an open position. Signals arriving at the antenna 170 are induced into loop elements 72 and 172, where they are each coupled into the transmission lines 36 and 126 via couplers 34, and 124. These signals are routed through the closed combiner switches 206 and 218 and process as described previously in this specification, so the pattern of FIG. 12 is realized with a northeast-southwest orientation.

In a similar manner, by moving the selector switch 232 so that the southeast LED 240 and northwest LED 248 are illuminated, a message is sent from the controller 12 to the signal processor 102 to close combiner switches 210 leaving remaining switches in FIG. 10 in an open position so the pattern of FIG. 12 is realized with a southeast-northwest orientation.

Continuing to refer to FIGS. 8, 9, 10, and 11, when the unidirectional push button 252 is pressed, a light emitting diode is lit indicating the commanded direction as discussed previously in this specification. When only the north LED 234 is illuminated, a message is sent to the signal processor 102 to close the switches 206, 208 and the bypass switch 203, leaving remaining switches in FIG. 10 in an open position. The signal arriving at the antenna 170 is induced into loop element 72, where it is coupled into the transmission line 36 via coupler 34. This signal is routed through the closed combiner switch 206 and fed onto the combiner signal bus 200 that is also connected to the combiner 90. The signal is also coupled into the transmission line 26 via coupler 24. The signal is routed through the closed delay switch 208 and fed onto the delay line signal bus 202 that is connected to the delay line 38 that subsequently is connected to the bypass switch 203 that is also connected to the combiner 90 and processed as described earlier. In this way, the antenna pattern shown in FIG. 15 is realized with a northerly orientation.

In a similar manner, by moving the selector switch 232 so that the south LED 242 is illuminated, a message is sent from the controller 12 to the signal processor 102 to close the switches 210, 204 and the bypass switch 203, leaving remaining switches in FIG. 10 in an open position. In this way, the antenna pattern shown in FIG. 15 is realized with a southerly orientation.

By rotating the selector switch 232 so that the east LED 238 is illuminated, a message is sent to the signal processor 102 to close the switches 218, 212 and the bypass switch 203, leaving remaining switches in FIG. 10 in an open position. The signal arriving at the antenna 170 is induced into loop element 172, where it is coupled into the transmission line 126 via coupler 124. This signal is routed through the closed combiner switch 218 and fed onto the combiner signal bus 200 that is also connected to the combiner 90. The signal is also induced into the transmission line 136 via coupler 134. The signal is routed through the closed delay switch 212 and fed onto the delay line signal bus 202 that is connected to the delay line 38 that subsequently is connected to the bypass switch 203 that is also connected to the combiner 90. At the combiner, signals coming from the favored direction, in this case from the east, are attenuated less than are signals coming from the un-favored direction as discussed previously in this specification. In this way, the antenna pattern shown in FIG. 15 is realized with an easterly orientation.

In a similar manner, by rotating the selector switch 232 so that the west LED 246 is illuminated, a message is sent from the controller 12 to the signal processor 102 to close the switches 214, 216 and the bypass switch 203, leaving remaining switches in FIG. 10 in an open position. In this way, the antenna pattern shown in FIG. 15 is realized with a westerly orientation.

Referring still to FIGS. 8, 9, 10, and 11 and by moving the selection switch 232 so that the northeast LED 236 is illuminated, a message is sent to the signal processor 102 to close the combiner switches 206, 218 and delay switches 208 and 212 leaving remaining switches in FIG. 10 in an open position. Signals arriving at the antenna 170 are induced into loop elements 72 and 172, where they are each coupled into the transmission lines 36 and 126 via couplers 34 and 124. These signals are routed through the closed combiner switches 206 and 218 to the combiner signal bus 200, traveling through the combiner 90 and following the path discussed previously in this specification.

Signals are also each coupled into the transmission lines 26 and 136 via couplers 24 and 134. These signals are routed through the closed delay switches 208 and 212 and fed onto the delay line signal bus 202 that is connected to the delay line 38 that subsequently is connected to the delay line 138 that is also connected to the combiner 90. At the combiner, signals coming from the favored direction, in this case from the northeast, are attenuated less than are signals coming from the un-favored direction as discussed previously in this specification. In practice, it has been found that the delay line 138 is optional, and can be removed if it is permanently bypassed.

In a similar manner, by moving the selector switch 232 so that the southeast LED 240 is illuminated, a message is sent from the controller 12 to the signal processor 102 to close combiner switches 210 and 218 and close delay switches 204 and 212 leaving remaining switches in FIG. 10 in an open position. In this configuration signals coming from the favored direction, in this case from the southeast, are attenuated less than are signals coming from the un-favored direction as discussed previously in this specification.

Also, in a similar manner, by moving the selector switch 232 so that the southwest 244 is illuminated, a message is sent from the controller 12 to the signal processor 102 to close combiner switches 210 and 214 and close delay switches 204 and 216 leaving remaining switches in FIG. 10 in an open position. In this configuration signals coming from the favored direction, in this case from the southwest, are attenuated less than are signals coming from the un-favored direction as discussed previously in this specification.

Finally, in a similar manner, by moving the selector switch 232 so that the northwest 244 is illuminated, a message is sent from the controller 12 to the signal processor 102 to close combiner switches 206 and 214 and close delay switches 208 and 216 leaving remaining switches in FIG. 10 in an open position. In this configuration signals coming from the favored direction, in this case from the northwest, are attenuated less than are signals coming from the un-favored direction as discussed previously in this specification.

In compliance with the statute, the invention has been described in language more or less specific as to structural and methodical features. It is to be understood, however, that the invention is not limited to the specific features shown and describe, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A compact directional antenna for receiving signals over a range of frequencies having respective wavelengths comprising:

a loop antenna element;

a first coupler located at a first point along the loop antenna element, and configured to transfer signals from the loop antenna element;

a first transmission line having a characteristic impedance, and a first end connected to the first coupler, and a second end, and operable to provide a first time delay for signals traveling from the first end to the second end;

a second coupler located at a second point along the loop element, and configured to transfer signals from the loop antenna element;

a second transmission line having the characteristic impedance, and a first end connected to the second coupler, and a second end, and operable to provide a second time delay for signals traveling from the first end to the second end;

a signal combiner having a first port having a first impedance, and coupled to the second end of the first transmission line, and a second port having the first impedance, and coupled to the second end of the second transmission line, and a third port, and wherein the signal combiner provides a third time delay for signals traveling from the first port to the third port, and wherein the signal combiner provides a fourth time delay for signals traveling from the second port to the third port.

2. The compact directional antenna as claimed in claim 1, and wherein the first and second couplers are current transformers.

3. The compact directional antenna as claimed in claim 2, and wherein the signal combiner is a hybrid coupler.

4. The compact directional antenna as claimed in claim 3, further comprising a buffer amplifier.

5. A compact directional antenna for receiving signals over a range of frequencies having respective wavelengths comprising:

a first loop antenna element;

a first coupler located at a first point, and configured to transfer signals from the loop antenna element;

a first transmission line having a characteristic impedance, and a first end connected to the first coupler, and a second end, and operable to provide a first time delay for signals traveling from the first end to the second end;

a second loop antenna element;

a second coupler located at a second point, and configured to transfer signals from the second loop antenna element;

a second transmission line having the characteristic impedance, and a first end connected to the second coupler, and a second end, and operable to provide a second time delay for signals traveling from the first end to the second end;

a signal combiner having a first port having a first impedance, and coupled to the second end of the first transmission line, and a second port having the first impedance, and coupled to the second end of the second transmission line, and a third port, and wherein the signal combiner provides a third time delay for signals traveling from the first port to the third port, and wherein the signal combiner provides a fourth time delay for signals traveling from the second port to the third port.

6. The compact directional antenna as claimed in claim 5, and wherein the first and second elements are formed in a common plane, and have a shape, and each is shaped as a triangle having a vertical side, and further wherein the vertical side of each of the first and second elements are positioned in parallel relation at a separation distance.

7. The compact directional antenna as claimed in claim 6, and wherein the separation distance is less than 1/100 of the respective wavelengths.

8. The compact directional antenna as claimed in claim 7, and wherein the first and second couplers are current transformers.

9. The compact directional antenna as claimed in claim 8, and wherein the signal combiner is a hybrid coupler.

10. The compact directional antenna as claimed in claim 9, further comprising a buffer amplifier.

11. An compact directional antenna for receiving signals over a range of frequencies having respective wavelengths comprising:

a first, second, third, and fourth loop antenna element;

a first coupler located at a first point, and configured to transfer signals from the first loop antenna element;

a second coupler located at a second point, and configured to transfer signals from the second loop antenna element;

a third coupler located at a third point, and configured to transfer signals from the third loop antenna element;

a fourth coupler located at a fourth point, and configured to transfer signals from the fourth loop antenna element;

a first, second, third, and fourth transmission line, each having a characteristic impedance, and each having a first end connected to the respective first, second, third, or fourth coupler, and a second end, and operable to each provide a first time delay for signals traveling from the first end to the second end;

a signal processing module having a first, second, third, and fourth ports each connected to the second end of the respective first, second, third, and fourth transmission lines, and a fifth port, and a sixth port;

a fifth transmission line having a characteristic impedance equal to the characteristic impedance, and having a first end connected to the fifth port of the signal routing module, and operable to provide a second time delay for signals traveling from the first end to the second end;

a signal combiner having a first port having an impedance equal to a first impedance, and coupled to the second end of the fifth transmission line, and a second port having an impedance substantially equal to the first impedance, and coupled to the sixth port of the signal routing module, and a third port, and wherein the signal combiner provides a third time delay for signals traveling from the first port to the third port, and wherein the signal combiner provides a fourth time delay for signals traveling from the second port to the third port.

12. The compact directional antenna as claimed in claim 11, and wherein the first and third elements are formed in a first common plane, and the second and fourth elements are formed in a second common plane that is orthogonal to the first common plane, and each of the elements have a shape, and each is shaped as a triangle having a vertical side, and further wherein the vertical side of each of the first and second elements are positioned in parallel relation at a separation distance.

13. The compact directional antenna as claimed in claim 12, and wherein the separation distance is less than 1/100 of the respective wavelengths.

14. The compact directional antenna as claimed in claim 13, and wherein the first, second, third, and fourth couplers are comprised as current transformers.

15. The compact directional antenna as claimed in claim 14, and wherein the signal combiner is a hybrid coupler.

16. The compact directional antenna as claimed in claim 15, further comprising a buffer amplifier.

* * * * *